United States Patent [19]

Patterson

[11] B 4,010,908

[45] Mar. 8, 1977

[54] METHOD AND APPARATUS FOR HANDLING LINEAR ELEMENTS

[75] Inventor: John L. Patterson, Granville, Ohio

[73] Assignee: Owens-Corning Fiberglas Corporation, Toledo, Ohio

[22] Filed: July 29, 1974

[21] Appl. No.: 492,373

[44] Published under the second Trial Voluntary Protest Program on March 30, 1976 as document No. B 492,373.

[52] U.S. Cl. ..... 242/36; 242/18 G; 242/42; 242/45

[51] Int. Cl.[2] ..... B65H 63/00

[58] Field of Search ..... 242/36, 37 R, 38, 42, 242/49, 28, 29, 129, 18 G, 45; 57/80, 81; 250/559, 561

[56] References Cited

UNITED STATES PATENTS

| | | | |
|---|---|---|---|
| 2,989,796 | 6/1961 | Ashe | 242/37 R X |
| 3,114,233 | 12/1963 | Guri | 57/81 |
| 3,189,288 | 6/1965 | Petersen | 242/37 R |
| 3,592,400 | 7/1971 | Gith | 242/36 |
| 3,746,276 | 7/1973 | Stotler | 242/129 |
| 3,772,524 | 11/1973 | Erbstein | 57/81 X |
| 3,801,031 | 4/1974 | Kamp et al. | 242/36 |

*Primary Examiner*—Stanley N. Gilreath
*Attorney, Agent, or Firm*—John W. Overman; Ronald C. Hudgens; Kenneth H. Wetmore

[57] ABSTRACT

Method of and apparatus for producing roving with a controlled number of strands including means for advancing a linear element along a given path; means for directing light to the element for reflection therefrom; means for sensing changes in the reflected light as an indication of changes in the speed of the elements advancement; means for supplying a signal in response to the changing reflected light; and means for controlling the advancement of the element in response to the signal.

15 Claims, 6 Drawing Figures

METHOD AND APPARATUS FOR HANDLING LINEAR ELEMENTS

BACKGROUND OF THE INVENTION

Textile operations often require simultaneously handling of many continuous linear elements, such as yarns or strands, to produce a product. Examples of such operations are roving and beaming. And the quality of the product depends upon the ability of apparatus to keep a positive end count of the linear elements being processed. So apparatus cannot be allowed to blithely operate without monitoring the movement of the linear elements during processing.

It has been a practice to produce a composite roving by withdrawing strands or rovings from packages held in creels and converging the strands or rovings into a group and winding the group on a rotatable packaging tube, collet or collector. It has been found that one of the major problems in producing such a composite linear product lies in maintaining a positive end count of the number of strands or rovings being combined. The specifications for different products vary, but there has been an increased requirement for accuracy in maintaining a predetermined number or minimum number of rovings or strands in the composite product. Thus, a need has developed for increased reliability and durability in control to meet specifications for a composite roving with a positive end count.

Apparatus has been used that performed an end count function as an incidental control in effecting a required tension on each strand to provide a composite roving made up of individual rovings having a substantially uniform tension. In U.S. Pat. No. 3,361,375 issued Jan. 2, 1968, an end count was provided by a drop member or drop wire held in elevated position by the tension of the roving threaded through a guide eye in the drop member. When the roving broke, the member normally fell to close a switch that effected interruption in the operation of a winding motor and a feed roll motor. While the above described approach was satisfactory for use in the device as described, difficulties were encountered. The apparatus as a whole was primarily a tension sensing and tension controlling device. Thus, if a tension controlling portion of the apparatus failed, it was possible to obtain a breakout signal although no strand was broken. Further, abrasion on the strand or roving may mechanically reduce the strength of the strand or roving and may further interfere with the functioning of the tensioning devices. In addition, breakage of the strand or roving at certain points of the apparatus may not be detected by the device since the licking or wrap around capabilities of a filament or strand may effect sufficient tension in the area of the drop wire or member supported by the strand to maintain support of the drop wire detecting member even though the strand is broken.

Other devices for handling linear elements have recently been developed. For example, one such device has a motion detection means that includes: a movably mounted guide member upon which the linear element is turned during advancement; and an electrical circuit effective to supply the intermittent electrical motion signals in response to the sense motion of the linear material during its advancement. The electrical circuit includes an electrical switch comprising a fixed electrical contact and an electrical conductor carried by and moving with the movable guide member. The electrical conductor intermittently contacts the fixed electrical contact during advancement of the linear element over the movable guide member.

Further, apparatus has been used that performs an end count function by providing a motion signal changing in magnitude with changes in the motion of the linear elements and control circuit responsive to the magnitude of the motion signals. For example, tachometer generators and piezoelectric crystals have been used. But these prior devices tend to be too frail and expensive for production use.

Improved controls have been needed.

SUMMARY OF THE INVENTION

An object of the invention is improved apparatus for and method of processing one or more continuous linear elements such as glass strands;

Another object of the invention is improved apparatus for and method of producing a roving with a controlled number of strands.

These and other objects are attained by apparatus including: means for linearly advancing a continuous linear element; means for directing a beam of light to the element for reflection therefrom; means for sensing changes in the intensity of the light reflected from the element as an indication of changes in the speed of its advancement; means for supplying a signal which varies in response to changes in intensity of the reflected light; and means for controlling the linear element advancing means in response to the signal.

Other objects and advantages will become apparent as the invention is described in more detail with reference made to the accompanying drawings.

DESCRIPTION OF THE PREFERRED EMBODIMENTS

The apparatus for and method of processing linear elements according to the invention are especially useful in processing multifilament linear textile elements, for example glass strand, into roving. But the invention is useful in processing other types of continuous linear elements. And the invention can be used in other types of operations, for example textile beaming.

Figure 1:
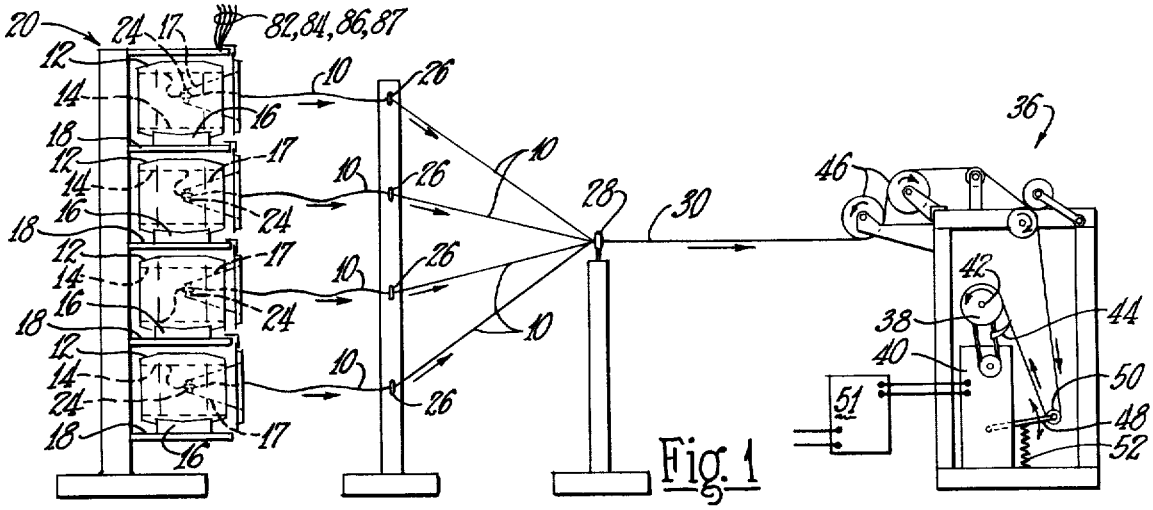
FIG. 1 is a simplified side elevation view of apparatus for producing roving from strand according to the principles of the invention.

FIG. 1 illustrates apparatus for producing glass roving according to the principles of the invention. A single collection means withdraws a continuous filament glass strand from the interior ("inside" withdrawal) of individual serving packages each having a hollow central region. The glass strands are withdrawn from one end of the packages to be gathered into a bundle or roving; the roving is collected into a single wound package. An individual strand motion detection means, which also functions as a strand guide, is located in the interior of the package as part of the strand guide apparatus described in U.S. Pat. No. 3,746,276. The detection means could of course be located immediately adjacent the exit end of each package if a different type of strand guide were used. And these detection means supply varying signals in response to sensed changes in the intensity of the light reflected from the strand during its advancement. Means responsive to the signals control the collection means.

Outside withdrawal from one end of a serving package can be used. Also, other types of serving packages, such as a yarn package, can be used.

In the specific embodiment illustrated in FIG. 1 the control means stops the collection means if a selected number of strand motion sensing devices (monitoring stations) indicate varying signals below predetermined changes in magnitude and frequency. For example, the controls can be set to shut off the collection means when the frequency of the variations of the signal from a single motion sensing device falls below predetermined frequency, when the magnitude of the variations of the signal from a single motion sensing device falls below predetermined values, or when a combination of the frequency and magnitude from a single motion sensing device falls below predetermined values.

Figure 2:
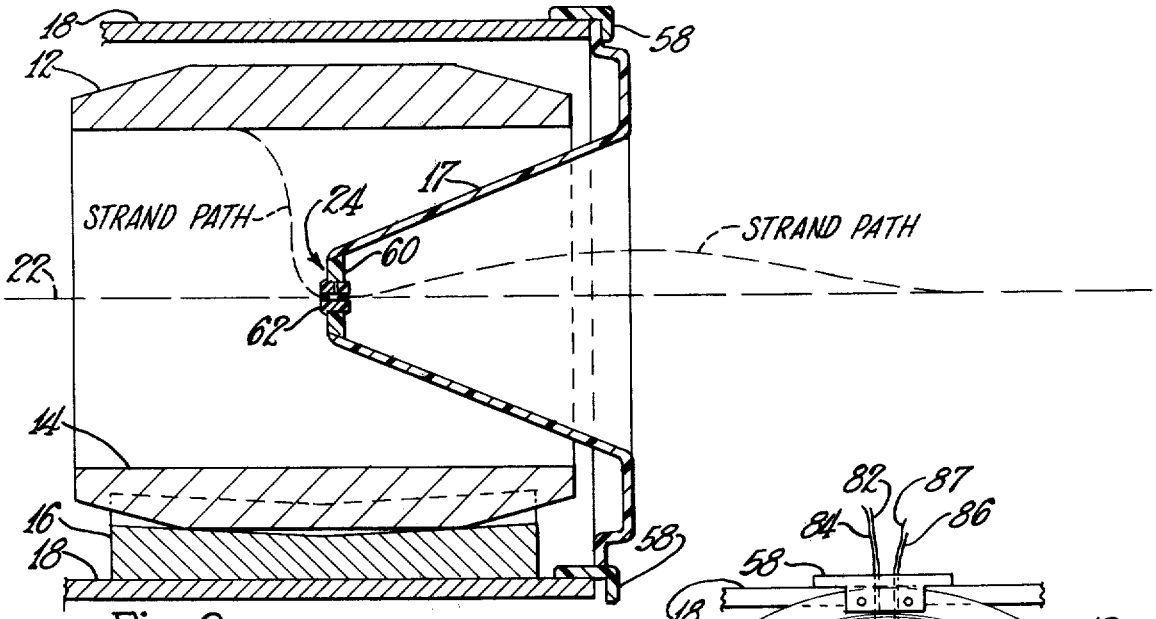
FIG. 2 is an enlarged side elevation view in cross section of one of the serving packages and strand motion sensing devices shown in FIG. 1.
Figure 3:
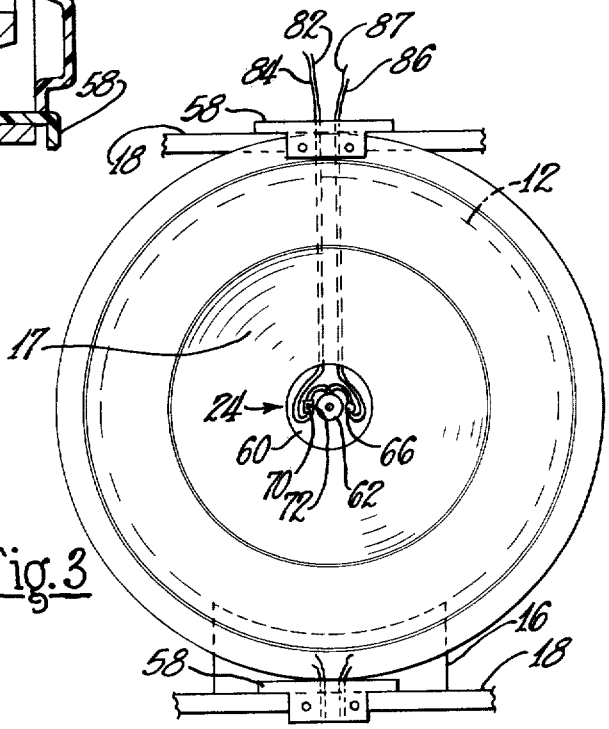
FIG. 3 is a front elevation view of the package and the strand motion sensing device shown in FIG. 2.

Referring to FIGS. 1–3, individual glass strands are withdrawn from the axial passageway or hollow central region 14 of individual wound serving packages 12. The packages 12 rest on cradles 16 each supported on a horizontal shelf 18 of a creel 20. So each of the packages 12 has its longitudinal axis disposed horizontally; the dashed line in FIG. 2 denoted by the reference numeral 22 indicates the horizontal axis of the illustrated package 12.

Four strands 10 are shown in the embodiment. But in practice it is common to process up to one hundred and more strands into a roving.

Each of the strands 10 is advanced in an axial direction through a guide opening in a strand withdrawal guide and motion sensing device 24. The advancing strands 10 turn, twist and bend as they pass through the guide 62 located in the individual sensing devices 24. From the devices the strands 10 are advanced laterally of the packages 12 and through separate external strand guides 26 spaced from the creel 20. A strand gathering quide 28 beyond the individual guides 26 combines or gathers the individual strands 10 into a bundle or roving 30.

A conventional textile take-up machine 36 is shown as the means for collecting the roving 30 into a wound package 38. The machine 36 includes a variable speed drive 40 for rotating a package collecting spool or mandrel 42, a strand traversing guide 44, a pair of constant speed feed rolls 46 and a pivotally mounted speed control arm 48 with a rotatable pulley 50 mounted on its free end. The roving 30 is advanced between the driven rolls 46 downwardly to the pulley 50 and is advanced upwardly to collect on the driven spool 42. The strand traversing guide 44 engages the roving 30 adjacent the collecting package 38 to reciprocate the roving 30 lengthwise of the collecting spool during package formation.

Controls in a box 51 control the operation of the take-up machine 36 in response to strand motion sensed by the devices 24.

The take-up machine 36 is responsive to tension in the advancing roving 30. The rolls 46 advance the rovings 32 to the collecting spindle 42 via the speed control arm 48 and the pulley 50. The arm 48, which includes electro-mechanical devices within the variable speed drive 40 (including a variable drive motor), controls the rotational speed of the spool 42 to keep a substantially constant tension in the roving 30 during collection. A spring 52 biases the arm 48 to introduce a selected tension into the roving 30 between the driven rolls 46 and the collecting spool 42.

FIGS. 2 and 3 show one of the motion sensing devices 24, which is held by a strand guide apparatus 17 as described in U.S. Pat. No. 3,746,276 which is held by a hinge support 58. The devices 24 could be held in the interior of the package as shown or it could be held immediately adjacent the exit end of each of the packages. The motion sensing device 24 as shown includes a hollow disc 60 for holding other parts of the device. The hollow disc 60 has an opening 62 in its central region through which strand travels during strand withdrawal and collection.

Figure 4:
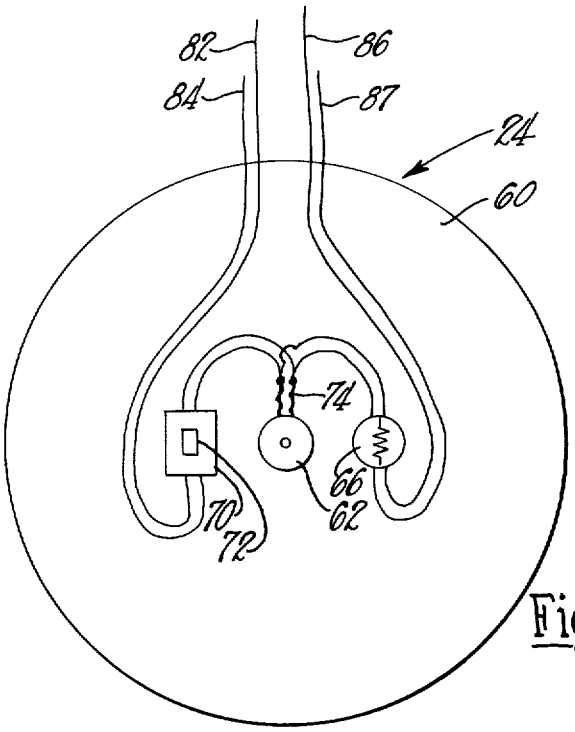
FIG. 4 is a still further enlarged front elevation view illustrating in more detail motion sensing apparatus within the motion sensing device shown in FIGS. 1–3.

FIG. 4 shows the mechanism within the hollow disc 60. The mechanism includes a light source 72 held in place by a support 70. Power is supplied through electrical wires (positive 82 and ground 84) from a power source to the light source. The light source is an electric light bulb. The bulb can be such that it focuses the light so that the light is directed in a beam. Light, from the light source 72 enters a portion of a bundle of optical fibers 74. The optical fibers can for example be optical glass fibers. The light travels through the optical fibers and is directed out the other end in a beam of light toward the strand 10 passing through the guide 62.

The strand guide 62 is made of a material which is not abrasive to glass filaments. In practice guides of graphite, ceramic and teflon have given good results. The guide opening is at least several times larger than the strand diameter. In practice the guide 62 is usually many times larger than the strand 10. Thus, the guide is large enough so that the strand turns and twists, moves back and forth, moves up and down, and moves around in the guide 62 during advancement. During advancement the strand 10 is continuously moving around and turning in the guide. The guide 62 can have its inside surface colored black to reduce light being reflected from the guide.

So, a beam of light is directed from the light source 72 toward the strand 10 through optical fibers. As the light strikes the strand 10, light is reflected off the strand 10. This reflected light from the strand varies in amount or intensity as the strand is being advanced. During advancement the strand 10 is moving back and forth and round and round in the guide 62. That is the strand is moving in and out of the beam of light. Thus the reflected light can vary in intensity and go on and off as the strand 10 moves. The frequency of the varying of the amount or intensity of the light varies with the movement of the strand. If the strand is not moving the frequency of changes in reflected light and the magnitude of the changes will be zero. As the strand moves faster the magnitude of change and frequency will increase. Another factor in the varying of the reflected light is that the strand 10 is not round and in fact is more ribbon like. So, as the strand twists during advancement different amounts of light are reflected from the different surfaces of the strand.

The reflected light from the strand 10 enters other optical fibers in the bundle 74. The light moves through these optical fibers to a light sensitive photo resistor 66. The resistance of the photo resistor 66 changes depending on the amount of light directed to it. When more light strikes the photo resistor 66 the resistance goes down and it becomes more conductive. When less light strikes the photo resistor 66 the resistance goes up and the resistor becomes less conductive.

So, as the frequency of the variances of the reflected light from the strand changes and the magnitude of those variances changes, it affects the conductivity of the photo resistor. When the strand 10 is not advancing the photo resistor 66 will stay at a near constant resistance. But when the strand 10 is moving the light reflected from it varies and so the resistance of the photo resistor 66 also varies.

The bundle of optical fibers 74 is shown to be like a coaxial cable with the center portion from the light source and the outside portion leading to the photo resistor 66. There could be two separate optical fibers or bundles of optical fibers. One from the light source to the guide and another from the guide to the photo resistor. The bundles would have to enter the guide at something other than 180° from each other or opposite each other so that light directed from one could be reflected from the strand and received by the other bundle of optical fibers.

Figure 5:
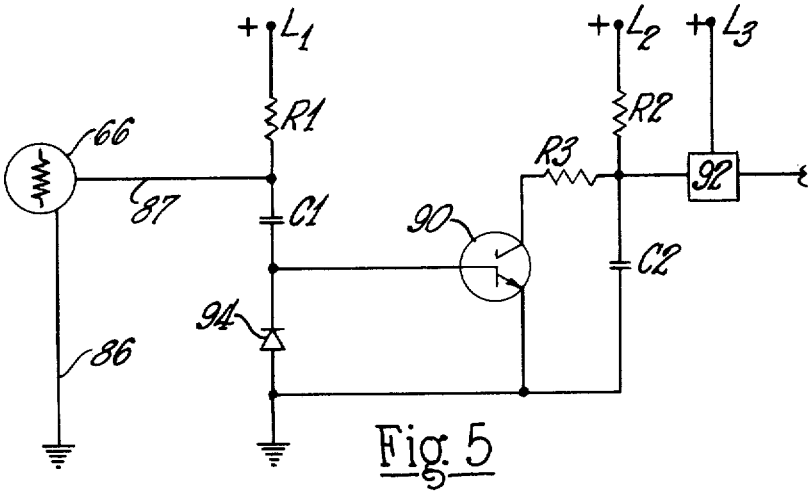
FIG. 5 is a circuit forming part of the controls for the apparatus shown in FIG. 1. The circuit operates directly with the motion sensing apparatus shown in more detail in FIG. 4.

FIG. 5 illustrates a detection circuit that is responsive to strand motion sensed by one of the devices 24 and that provides a time varying signal in response to the changes in reflected light from the strand. There is a detection circuit for each device 24.

The signals control the operation of a transistor 90 used as an on-off switch. And the transistor 90 controls the operation of a Schmidt trigger 92. In the circuit a capacitor C1 is charged through a resistor R1 by a positive DC voltage applied at $L_1$. The lead 87 from the strand motion sensing device 24 forms a junction with the circuit between the capacitor C1 and the resistor R1. So when the photo resistor 66 is turned on (made to conduct), the voltage applied at $L_1$ through resistor R1 is grounded and the capacitor C1 is discharged. When a strand 10 is advanced through a device 24, its photo resistor 66 is continually being made more and less conductive by the charging reflected light intensity from the advancing strand 10. Accordingly, during strand advancement through a device 24 the capacitor C1 is being alternately charged and discharged.

The capacitor C1 is electrically connected to the base of the transistor 90. The transistor is turned-on by the biasing voltage applied to the base of the transistor 90 during times the capacitor C1 is charged (the photo resistor 66 is non-conductive or of a high resistance). Similarly, the transistor 90 is turned-off when the capacitor C1 is discharged (the photo resistor 66 is conductive or of a low resistance). So the transistor 90 is alternately being opened and closed by the charging and discharging of the capacitor C1 during strand withdrawal.

Diode 94 provides a low impedance discharge path for capacitor $C_1$ during the time when the photo resistor 66 is conductive.

The control circuit of FIG. 5 also includes a firing capacitor C2. This capacitor is charged through a resistor R2 by positive DC voltage applied at $L_2$. The capacitor C2 is charged during times the transistor 90 is turned-off; similarly, the capacitor C2 is discharged to ground through a resistor R3 and the transistor 90 during times the transistor 90 is turned-on by the charging current developed through capacitor C1.

The capacitor C2 controls the operation of the trigger 92. During normal strand withdrawal speeds the photo resistor 66 is varied between conductive and non conductive sufficiently often and by sufficient amounts by the changing amount of light reflected from the strand. The capacitor C2 is prevented from being charged sufficiently to activate or trigger the trigger 92. In other words, the transistor 90 is closed sufficiently often to discharge the capacitor C2 often enough to keep the charging voltage below the firing voltage for the trigger 92. However, if the frequency of the transistor 90 closing becomes too low, the capacitor C2 will charge sufficiently to fire the trigger 92. It is possible to modify the rate at which the capacitor C2 is charged. For example, one might change the voltage applied at $L_2$ or vary the resistance of R2.

The trigger 92 is supplied a positive DC voltage from L3. And this voltage appears as a steady positive voltage from the trigger 92 so long as the trigger 92 is activated. So when a strand 10 breaks, the varying signal from the changes in reflected light ceases and associated trigger 92 supplies a steady output voltage signal. But during normal strand withdrawal the frequency of the signals and the varying of the signal magnitudes is sufficient to keep the capacitor C2 below the firing voltage of the trigger 92. Hence, there is no output voltage signal from the trigger 92 during normal strand withdrawal.

In the embodiment shown each of the molten sensing devices 24 electrically connects to an individual detector circuit as shown in FIG. 5.

Figure 6:
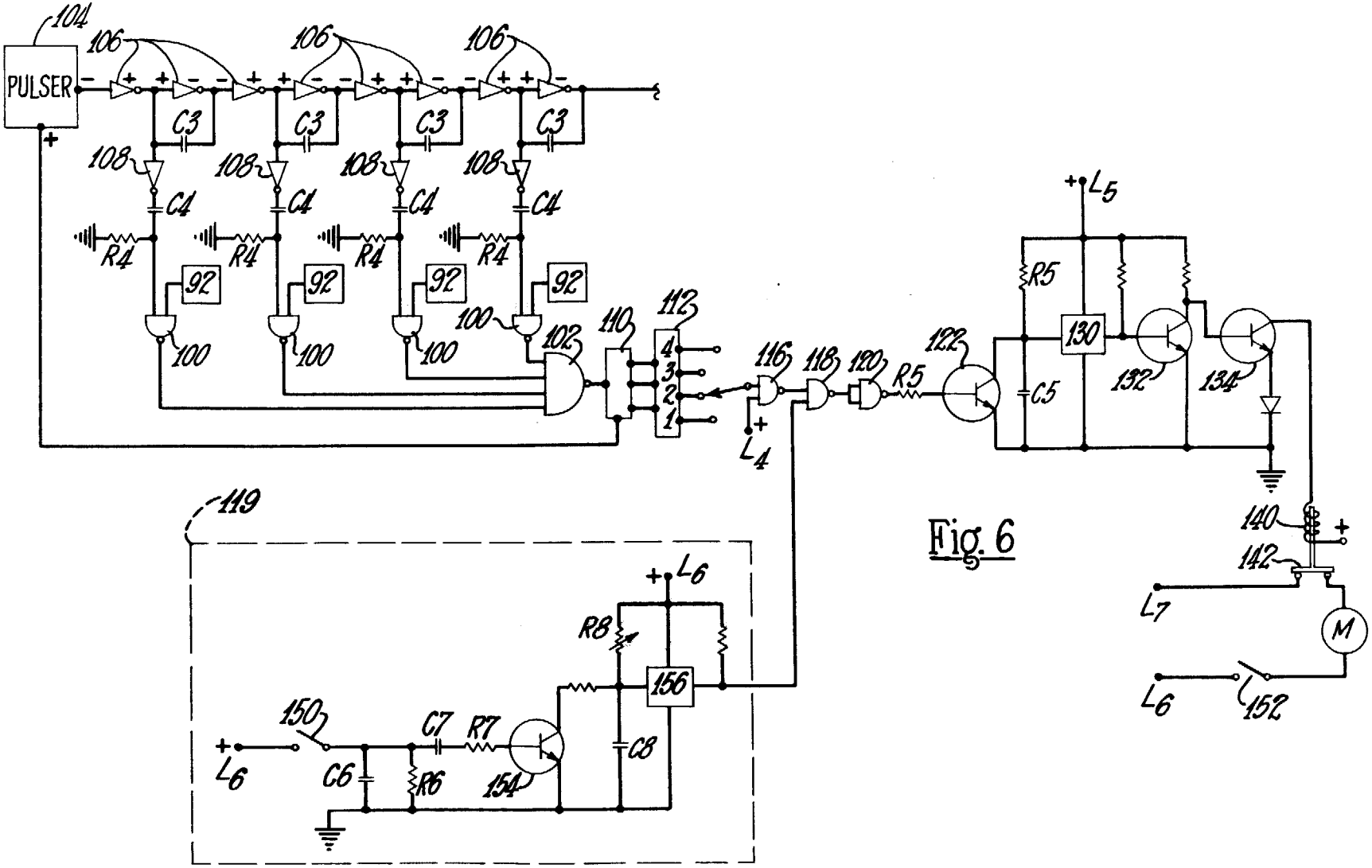
FIG. 6 illustrates an electrical circuit for the other controls of the apparatus of FIG. 1. This circuit receives electrical signals from individual circuits like the circuit shown in FIG. 5.

FIG. 6 illustrates additional controls for operation of the apparatus of FIG. 1. These controls are effective to shut off the take-up machine 36 when the speed of a selected number of the strands 10, as sensed by the device 24, falls below a selected speed. In practice, the controls are normally used to shut off the machine 36 when a selected number of strands 10 break. In other words, the machine 36 is shut off when there is no motion signals from a selected number of strands.

As shown in FIG. 6, the Schmidt trigger 92 in each of the detector circuits shown in FIG. 5 connects as an input to a double input NAND gate 100.

A scan signal is supplied as the other input to each of the gates 100.

There is an output voltage signal from each of the gates 100 when there is only one input voltage signal. In other words, each of the gates 100 must have simultaneously supplied to it both a scan signal input and a signal input from one of the triggers 92 to stop its output signal. Otherwise there is a steady voltage signal from each gate 100. So when all 4 strands shown in FIG. 1 are running properly each of the gates 100 supply a steady voltage signal to a 4 input summing NAND gate 102.

A scanning signal is supplied periodically to each of the gates 100 through a pluse shaping delay network. As shown in FIG. 6 a square-wave pulser 104 periodically supplies voltage signals to a string of electrically connected inverters 106. Each alternate inverter 106 has a bridging capacitor C3 between its input and output. Consequently, this network provides a time lag where each alternate inverter 106 and its associated capacitor C3 combination provides a delay. A voltage signal from pulser 104 is thereby divided into discrete or separated pulses each providing an input to an individual NAND gate 100. And these input pulses are provided in sequence to individual legs of the circuit.

Each scan signal travels to the input of each of the gates 100 through a pulse shaped 108 and a differentiating network including a capacitor C4 and a grounded resistor R4. Each time the pulser 104 supplies a scanning pulse and input voltage signal is supplied to each of the gates 100 before the pulser 104 supplies another signal. If there is no companion voltage signal from the detector circuit of FIG. 5 (a trigger 92), each of the gates 100 continues to supply a constant positive voltage output signal. If a voltage signal from trigger 92 combines with a scan pulse, the output from the effected gate 100 drops to zero for the remaining duration of the scan time.

The output of the summing NAND gate 102 electrically connects to a digital counter 110 that operates in a conventional manner. From the output of the gate 102 the counter 110 registers the number of zero signals received from the gates 100 during each scan. For example, if there are two broken strands 10, the gate 102 will receive an individual zero signal from each of the effected gates 100. This will result in two zero signal pulses from the summing gate 102. And the counter 110 will register these.

The pulser 104 supplies a reset signal to the counter 110. Hence, upon completion of a scan signal from the pulser 104, which can result in a registered count in the counter 110, the reset signal from the pulser 104 clears the counter 110. The reset signal is 180 degrees out of phase with the scan signal.

The counter 110 connects to a digital decimal decoder 112 that operates in a conventional manner. The decoder stops its output signal upon receiving a signal indicating a selected number of strands 10 are being improperly advanced, e.g. are broken. In FIG. 6 the decoder 112 is set for two strand breaks.

The output of the decoder 112 is connected as an input to a two input NAND gate 116. The other input to the gate 116 is a steady positive voltage applied at $L_4$. So when the input from the decoder 112 is positive, the output of the gate 116 is zero. Conversely, when the decoder 112 reaches the selected count (selected number of strand breaks) and its signal becomes zero. the output from the gate 116 becomes positive.

The output of the gate 116 is one of two inputs to a two input NAND gate 118; the other input to the gate 118 is from an inhibit stop circuit 119 that inhibits the operation of the control circuit of FIG. 6 during start-up of the take-up machine 36.

The gate 118 supplies a no signal output only upon receipt of a positive input from the gate 116 and a positive signal from the inhibit stop circuit 119. And this occurs only when the signal from the decoder 112 drops to zero and there is a positive signal from the inhibit stop circuit 119.

The output from the gate 118 is the input to an inverter 120. The output of the inverter 120 goes to the base of a transistor 122 through a resistor R5.

The transistor 122 is an on-off switch that controls a command circuit including a Schmidt trigger 130, a transistor 132 and a transistor 134.

The firing capacitor C5 of the command circuit is charged through a resistor R5 by positive DC voltage applied at $L_5$. Since the transistor 122 is normally open, the Schmidt trigger 130 is normally held activated by the charged capacitor C5. So the trigger 130 normally supplies a positive voltage output signal. And this output is supplied to the base of the transistor 132. So the transistor 132 is normally closed. Thus, in normal strand running conditions, the transistor 132 is closed and the transistor 132 is open.

The transistor 134 controls energization of a control coil 140. And the coil 140 opens and closes a switch 142 that is in the circuit supplying electrical energy to the drive motor M of the take-up machine 36. Electrical energy is applied across leads $L_6$and $L_7$.

At start-up the switch 150 (in the inhibit circular 119) and the switch 152 (in the motor electrical supply circuit) are closed. A positive voltage (supplied at $L_6$) is applied to the inhibit circuit of the controls upon closing the switch 150; electrical energy is supplied to the drive motor M of the take-up machine 36 upon closing the switch 152.

Closing the switch 150 effects only a pulsed voltage to the base of a transistor 154 in the inhibit circuit 119 because of a RC network including capacitors C6 and C7 and resistors R6 and R7. This pulse closes the transistor 154 to discharge a firing capacitor C8 to ground. And such discharging resets the capacitor C8 for timed charging. The transistor 154 immediately opens and the capacitor C8 is charged through variable resistor R8 from positive DC voltage applied at $L_6$.

The capacitor C8, upon being sufficiently charged, fires a Schmidt trigger 156. The trigger 156 in turn gives a steady positive voltage signal to the gate 118 throughout package formation by the take-up machine 36.

It is possible to vary the time for charging the capacitor C8 by changing the resistor R8. And in practice this is done to activate the controls for the particular start-up time needed or wanted for the take-up machine 36.

In operation an operator begins build of a package 38 by closing switches 150 and 152. As the take-up machine 36 accelerates to speed, the inhibit circuit keeps its input to the gate 118 zero. So the controls permit the strands 10 to be advanced without regard to their motions until the inhibit circuit supplies a positive input to the gate 118.

During package build the strand motion detection means senses the varying intensity of light reflected from the strands 10 during their advancement and supplies intermittent electrical motion signals for each of the strands 10. And control means responsive to the motion signals controls the means for advancing the strands. As shown these control means shut off the take-up machine 36 when a selected number of strands are broken. But other functions can be performed. For example, the controls might be used to turn on lights or ring alarms to alert an operator that a number of strands 10 are broken.

In conclusion, it is pointed out that while the illustrated examples constitute practical embodiments of the invention, it does not limit it to the exact details shown, since modifications of these details may be made without departing from the spirit and scope of this invention as defined in the claims.

I claim:

1. A method for handling a linear element comprising:

a. linearly advancing a linear element along a given path such that a beam of light directed to the element is reflected therefrom with varying intensity with regard to the speed of advancement of the element;

b. directing a beam of light to the element for reflection therefrom;

c. sensing changes in the intensity of the light reflected from the element as an indication of changes in the speed of its advancement;

d. supplying a signal which varies in response to changes in intensity of the reflected light; and e. controlling advancement of the linear element in response to the signal.

2. A method for handling a plurality of linear elements comprising:

a. linearly advancing each linear element along a given path such that light directed to each element is reflected therefrom with varying intensity with regard to the speed of advancement of each element;

b. directing light to each element for reflection therefrom;

c. sensing changes in the intensity of the light reflected from each element as an indication of changes in the speed of its advancement;

d. supplying signals which vary in response to changes in intensity of the reflected light from each element; and e. stopping advancement of all of the linear elements when the magnitude and frequency of variation of at least one of the signals falls below a predetermined value.

3. The method of claim 2 in which the advancement of all of the linear elements is stopped when at least one of the signals stops varying.

4. A method for handling a linear element comprising:

a. linearly advancing a linear element along a given path such that light directed to the element is reflected therefrom with varying intensity with regard to the speed of advancement of the element;

b. directing light to the element for reflection therefrom;

c. sensing changes in the intensity of the light reflected from the element as an indication of changes in the speed of its advancement;

d. supplying a signal which varies in response to changes in intensity of the reflected light; and e. controlling advancement of the linear element in response to both the magnitude and frequency variations of the signal.

5. A method for packaging roving from a plurality of individual strands comprising:

a. supplying a plurality of strand packages;

b. withdrawing a strand from each forming package;

c. linearly advancing each strand along a given path such that light directed to each element is reflected therefrom with varying intensity with regard to the speed of advancement of each element;

d. gathering the advancing strands to combine them into a roving;

e. winding the roving into a roving package;

f. directing light to each strand during its withdrawal for reflection therefrom;

g. sensing changes in the intensity of the reflected light from each strand as an indication of the changes in the speed of their advancement;

h. supplying signals which vary in response to changes in intensity of the reflected light from each strand; and i. controlling advancement of the strands in response to the signals.

6. The method of claim 5 in which the advancement of all the strands is stopped when the magnitude and frequency of variation of at least one of the signals falls below a predetermining value.

7. The method of claim 5 in which the advancement of all the strands is stopped when at least one of the signals stops.

8. An apparatus for handling a linear element comprising:

a. means for linearly advancing a linear element along a given path such that light directed to the element is reflected therefrom with varying intensity with regard to the speed of advancement of the element;

b. means for directing light to the element for reflection therefrom;

c. means for sensing changes in the intensity of the light reflected from the element as an indication of changes in the speed of its advancement;

d. means for supplying a signal which varies in response to changes in intensity of the reflected light; and e. means for controlling advancement of the linear element in response to the signal.

9. The apparatus of claim 8 wherein the light is directed through optical fibers to the element.

10. The apparatus of claim 8 wherein the light reflected from the element passes through optical fibers before changes in intensity are sensed.

11. An apparatus for handling a linear element comprising:

a. means for linearly advancing a linear element along a given path such that a beam of light directed to the element is reflected therefrom with varying intensity with regard to the speed of advancement of the element;

b. means for directing a beam of light to the element for reflection therefrom;

c. means for sensing changes in the intensity of the light reflected from the element as an indication of changes in the speed of its advancement;

d. means for supplying a signal which varies in response to changes in intensity of the reflected light; and e. means for controlling advancement of the linear element in response to both the magnitude and frequency variations of the signal.

12. Apparatus for packaging roving from a plurality of individual strands comprising:

a. means for supplying a plurality of strand packages;

b. means for withdrawing a strand from each forming package;

c. means for linearly advancing each strand along a given path such that light directed to each element is reflected therefrom with varying intensity with regard to the speed of advancement of the element;

d. means for gathering the advancing strands to combine them into a roving;

e. means for winding the roving into a roving package;

f. means for directing light to each strand during its withdrawal for reflection therefrom;

g. means for sensing changes in the intensity of the reflected light from each strand as an indication of the changes in the speed of their advancement;

h. means for supplying signals which vary in response to changes in intensity of the reflected light from each strand; and i. means for controlling advancement of the strands in response to the signals.

13. An apparatus for handling a strand withdrawn from the inside of a hollow strand serving package comprising:

a. means for linearly advancing a strand along a given path such that light directed to the strand is reflected therefrom with varying intensity with regard to the advancement of the strand;

b. guide means located within the hollow interior of the strand serving package, the advancing strand passing through the guide means;

c. means for directing light to the strand for reflection therefrom;

d. means for sensing changes in the light reflected from the strand as an indication of the strand advancement speed;

e. means for supplying a signal which varies in response to changes in the reflected light; and f. means for controlling advancement of the strand in response to the signal.

14. The apparatus of claim 13 wherein the means for directing light is located in the interior of the serving package at the guide means.

15. The apparatus of claim 13 wherein the means for sensing changes in the light reflected from the strand is located in the interior of the serving package at the guide means.

* * * * *